United States Patent [19]

Crowley

[11] 4,270,323

[45] Jun. 2, 1981

[54] CONCRETE TANK

[76] Inventor: Francis X. Crowley, 24 Lanark Rd., Wellesley, Mass. 02181

[21] Appl. No.: 35,615

[22] Filed: May 3, 1979

[51] Int. Cl.[3] ..... E04H 12/16

[52] U.S. Cl. ..... 52/224; 52/248; 52/747; 264/32

[58] Field of Search ..... 52/224, 227, 223, 244–249, 52/741, 747; 264/32

[56] References Cited

U.S. PATENT DOCUMENTS 3,280,525 10/1966 Crowley ..... 52/224

FOREIGN PATENT DOCUMENTS 2508470 4/1976 Fed. Rep. of Germany ..... 52/248

2343104 7/1977 France ..... 52/247

*Primary Examiner*—John E. Murtagh

[57] ABSTRACT

A prestressed concrete tank with a wall of precast concrete panels surrounded by a cast-in-place beam, the beam and panels being prestressed by metal members in tension, encased within or placed around the outside of the beam.

14 Claims, 5 Drawing Figures

FIG 5
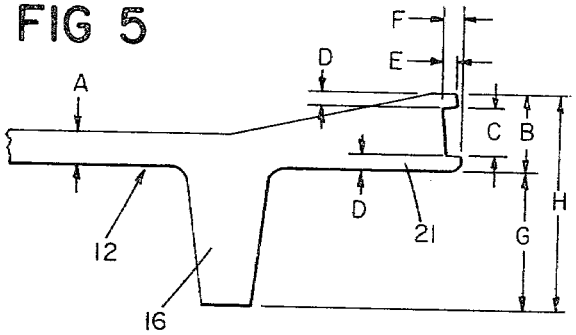
FIG 1
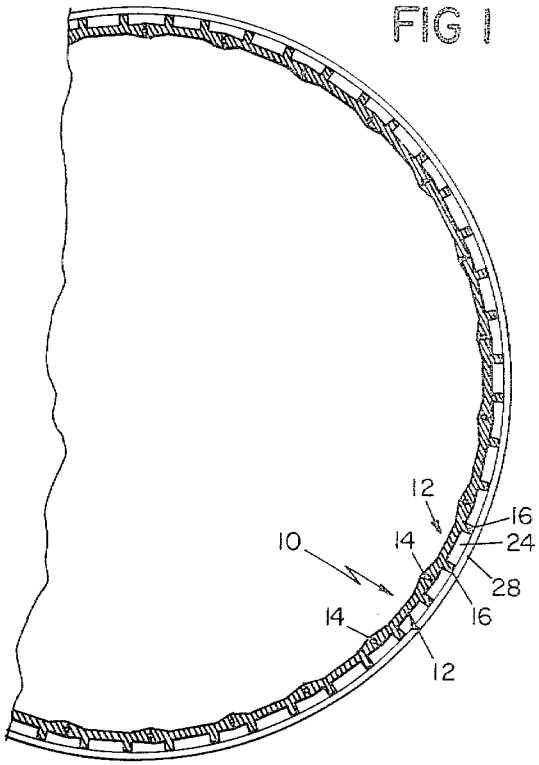
FIG 3
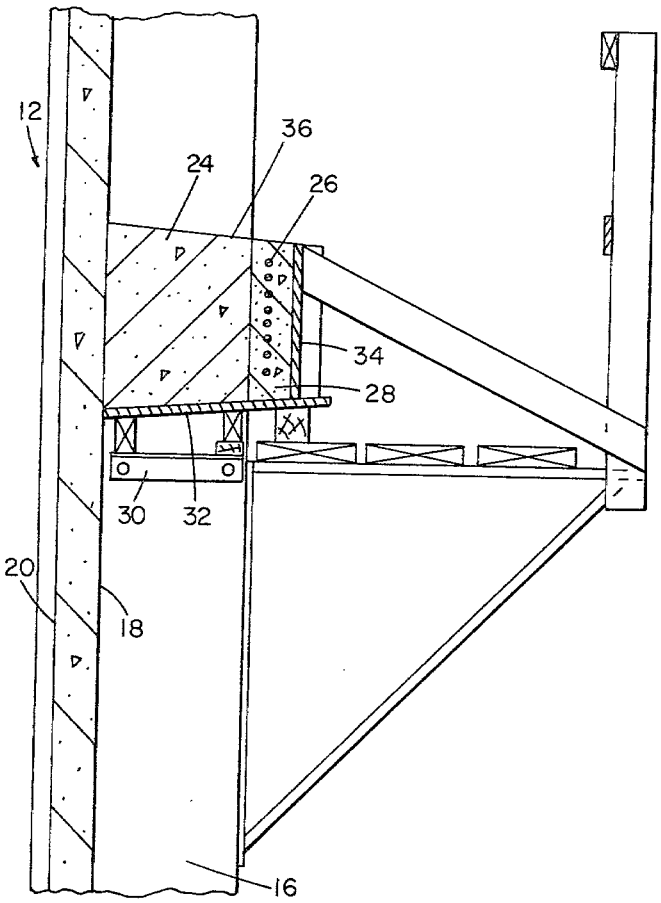
FIG 2
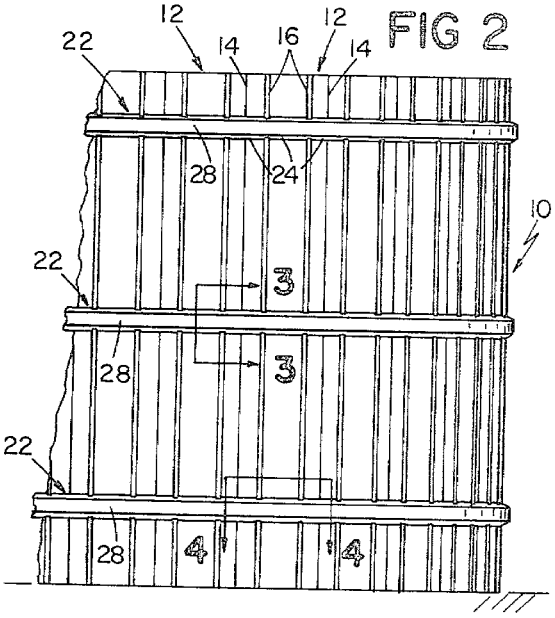
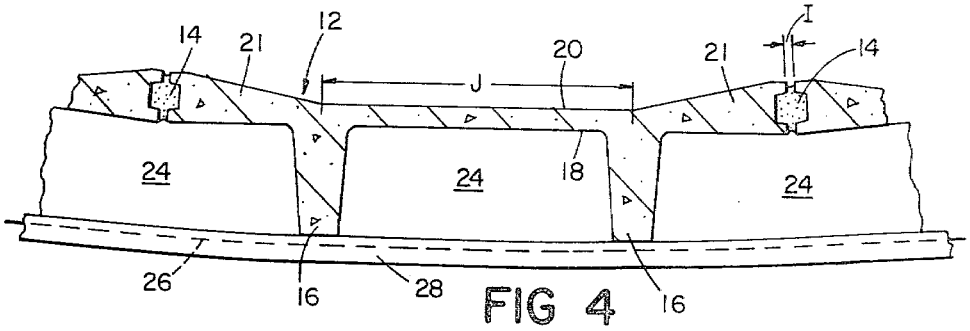
FIG 4

CONCRETE TANK

FIELD OF THE INVENTION

This invention relates to prestressed concrete tanks.

BACKGROUND OF THE INVENTION

It is well known to construct such tanks using precast panels, e.g., my U.S. Pat. Nos. 3,280,525 and 3,408,784. And it is known to precompress the panels by wrapping wire tendons around their outside surfaces and encasing the wire in a concrete beam surrounding the tank wall, e.g., my U.S. Pat. Nos. 4,015,383 and 4,126,976. Only the precast panels themselves have been precompressed by the wire tendons, not the wire-encasing beams, and thus the panels have been made relatively heavy to provide the required strength to support the contents (e.g., water) of the tank. Furthermore, the panels have generally been specially cast for the particular tank in which used.

A prior-art tank built in Lubbock, Texas, and designed by me uses precast panels that include integral outwardly-protruding portions that when erected form a circular beam surrounding the tank. Prestressing wire is wrapped around the outside of the tank to precompress the panels and integral beam.

SUMMARY OF THE INVENTION

I have found that lighter and less-costly panels can be used if an intermediate, cast-in-place, circular, precompressed beam is formed on the outside of the panels. In preferred embodiments, the panels and intermediate beam are precompressed by wire strands placed around the outside of the intermediate beams and the prestressed wire strands are encased in an outer non-prestressed beam to protect them from corrosion; commercially-available double-T panels are used with their two ribs extending outward; the intermediate beam is formed by filling the spaces between the ribs with cast-in-place bars of concrete, whereby the cast-in-place bars and adjoining portions of the panel ribs interleaved between the bars together from the circular intermediate beam; and the double-T panels are modified on their inner surfaces to have a thin central portion and thicker edge portions, to achieve light weight while also providing sufficient edge thickness to provide strong inter-panel joints.

The invention permits the precast panels to be lighter weight because much of the tank wall strength is provided by the cast-in-place, precompressed beam. Lighter weight panels can be transported to the tank site and erected at less cost. Furthermore, the panels are less costly to fabricate, as less prestressing steel and less concrete is required. The double-T panels of the preferred embodiments are commercially available at less cost than specially-cast panels. And fewer circular beams are needed for the same height tank.

PREFERRED EMBODIMENT

The structure and operation of a preferred embodiment of the invention will now be described, after first briefly describing the drawings.

DRAWINGS

FIG. 1 is a plan view of a portion of a tank wall embodying the invention.

FIG. 2 is an elevation view of the tank wall.

FIG. 3 is an enlarged vertical cross section taken along 3—3 of FIG. 2, showing one of the circular beams that surround the tank wall and also showing a temporary wooden frame used for casting the circular beams.

FIG. 4 is an enlarged horizontal cross section taken along 4—4 of FIG. 2.

FIG. 5 is an enlarged horizontal cross section of one end of one panel, showing panel dimensions.

STRUCTURE

FIG. 1 shows a portion of a circular tank wall 10 made up of several 8-foot wide double-T concrete panels 12. The panels are mounted in an annular groove in a circular concrete base (not shown) as described in my U.S. Pat. No. 4,078,354. Vertical joints 14 between panels are formed from cast-in-place mortar. Each double-T panel has two ribs 16 spaced 4 feet apart and extending 14 inches outward from outside flat surface 18. Inner surfaces 20 are shaped (FIG. 4) to provide greater thickness at edges 21 (FIGS. 4 and 5) than at the center.

Three circular beams 22 are formed around the outside of wall 10. The beams are formed by casting discrete bars 24 of concrete between ribs 16 using the forms of FIG. 3. The bars work together with adjacent, interleaved portions of ribs 16 to form the circular beams. Prestressing strand 26 (at least $\frac{1}{4}$ inch diameter) is placed around the outside of each circular beam 22 and used to prestress the beams and the panels. A circular non-prestressed beam 28 of concrete caps the wire strand rings to shield them from corrosion. Integral small ribs (not shown) on the outside of each bar 24 are used to space strand 26 at least $\frac{3}{8}$ inch away from the outside of bars 24 and panel ribs 16 during assembly. If more than one layer of strand is used (one shown), further spacer blocks (not shown) are provided between the strand layers to space the layers at least $\frac{3}{8}$ inch apart. The small ribs (not shown) on the outside of each bar 24 also serve to support galvanized steel (26 gauge) barrier layers (not shown) wrapped around the outside of bars 24 and ribs 16 and inside ring 28. The barrier layers and small ribs are like those of my U.S. Pat. No. 4,126,976, hereby incorporated by reference.

The panel dimensions given in FIGS. 4 and 5 are as follows: A is 4 inches; B is 6 inches; C is 4 inches; D is 1 inch; E is 2 inches; F is 2 7/16 inches; G is 14 inches; H is 20 inches; I is $\frac{3}{4}$ inch; and J is 4 feet. The actual width of the panel is 7 feet and $11\frac{3}{4}$ inches.

METHOD OF CONSTRUCTION AND OPERATION

Panels 12 are erected to their vertical position, and secured at their bases in the manner described in my U.S. Pat. No. 4,078,354. Panels 12 are spaced circumferentially so as to leave spaces between their edges for joints 14, and the spaces are then filled with cast-in-place mortar. Cover plates (not shown) of galvanized steel are positioned across the outsides of joints 14 and fixed to the adjacent panels.

Bars 24 are cast in place using the wooden frame shown in FIG. 3. Angle brackets 30 are secured to ribs 16, and sloping plywood boards 32 are supported above the angle brackets in the spaces between ribs 16. Initially, vertical plywood boards 34 are positioned radially inward of the position shown in FIG. 3 such that the board's inner surface is even with the position shown for strands 26. The sheet metal barriers and small ribs on bars 24 are provided by tacking the barrier (already bent to have the shape of the small ribs) to the inside of plywood boards 34. The inside surface of the barrier is flush with the outside surfaces of ribs 16. Concrete is then poured into the cavities defined by plywood boards 32, 34 and the surfaces of panels 12, to form bars 24.

After bars 24 are cast, boards 34 are removed, and prestressing strand 26 is placed around the barriers and small ribs on bars 24 and is used to prestress the bars and panels 12 putting them into compression. Form boards 34 are then re-erected in the position shown in FIG. 3, and outer concrete beams 28 are cast in place. While filling, the mortar is vibrated to assure that it completely surrounds strand 26. The tops of bars 24 and beams 28 are troweled smooth to give downwardly beveled surface 36, to drain surface water from the beams. The remainder of the frame surrounding the tank provides temporary access for performing these various construction steps. The above steps would be repeated for each circular beam (three shown).

In use, wire strand 26 precompresses panels 12 and bars 24. The bars and adjoining intervening portions of ribs 16 form structurally-continuous, precompressed beams that surround the tank at three vertically-spaced locations. The presence of the precompressed beams means that less strength is required of the remainder of the panels, meaning that they can be of thinner cross section and thus less weight.

Other embodiments will occur to those skilled in the art. For example, prestressing of beams 22 and panels 12 could be achieved by wire tendons internal to beams 22 or by wire wrapped around outside of the beams and encased in beam 28. A container without a top could be provided; for example, a slipformed barrier wall container for a cryogenic tank. (In the last-mentioned instance, the beams not only would permit achieving a reduction in the concrete requirement, but also higher psi prestress in horizontal wall plane sections with less vertical prestress steel in the wall itself (because of the thinner walls permitted), and in addition would, because of the thinner walls, be subjected to less bending stress caused by the temperature drop across the wall when exposed on the inside to liquid gas.) Because of the beams, an advantage when slipforming walls is that a simple smooth external surface may be formed, as opposed to the complexity when troughs must be periodically formed around the outer surface to accommodate therein stressing steel.

What is claimed is:

1. A prestressed concrete tank, comprising:
a wall of precast concrete panels,
a plurality of discrete, cast-in-place, precompressed, horizontal, collar-shaped beams surrounding said wall of panels,
said beams being vertically spaced from each other along said wall,
the total circumferential area of said beams being less than the circumferential area of said wall of panels, and
means for precompressing said beams and panels during construction of said tank.

2. The tank of claim 1 further comprising an outer beam surrounding said precompressed beam and including metal means for precompressing said panels and precompressed beam, said outer beam not being precompressed.

3. The tank of claim 2 wherein said metal means for precompressing includes steel wire wrapped circumferentially around said tank and within said outer beam.

4. The tank of claim 2 wherein the upper surfaces of said precompressed beam and outer beam form a continuous, downwardly beveled surface to drain surface water from said beams.

5. A prestressed concrete tank comprising:
a wall of precast concrete panels,
said panels having a transverse cross section with ribs extending generally radially outward,
a cast-in-place, precompressed beam surrounding said wall of panels,
said precompressed beam being formed of discrete cast-in-place bars filling the voids between said ribs,
said bars cooperating with portions of said ribs interleaved between said bars to form a structurally-continuous, precompressed beam, and
means for precompressing said beam and panels during construction of said tank.

6. The tank of claim 5 wherein said panels have greater thickness at their longitudinal edges than at their center, whereby sufficient edge thickness can be provided to give strong inter-panel joints while panel weight is reduced by less thick center portions.

7. The method of constructing a tank of prestressed, precast panels, comprising the steps of:
erecting said precast panels to form the wall of said tank,
casting a plurality of discrete, horizontal, collar-shaped beams in place surrounding said wall,
said beams being vertically spaced from each other along said wall,
the total circumferential area of said beams being less than the circumferential area of said wall of panels, and
wrapping metal prestressing means in tension around said tank over said beams to precompress said beams and panels.

8. The method of claim 7 further comprising the steps of casting in place an outer beam over said metal prestressing means to protect said metal from corrosion.

9. The method of claim 8 wherein said metal prestressing means is prestressing wire.

10. The method of constructing a tank of prestressed, precast panels, comprising the steps of:
erecting said precast panels to form the wall of said tank,
said panels having a transverse cross section with ribs extending generally radially outward,
casting a beam in place surrounding said wall,
said beam being formed of discrete cast-in-place bars filling the voids between said ribs, and
wrapping metal prestressing means in tension around said tank over said beam to precompress said beam and panels,
said bars cooperating with portions of said ribs interleaved between said bars to form a structurally-continuous, precompressed beam.

11. The tank of claim 6 wherein said thicker edges are achieved by shaping the inner surfaces of said panels and leaving the outer surfaces flat.

12. A prestressed concrete container comprising:
a concrete wall,
a plurality of discrete, cast-in-place, precompressed, horizontal, collar-shaped beams surrounding said wall, said beams being vertically spaced from each other along said wall, the total circumferential area of said beams being less than the circumferential area of said wall, and means for precompressing said beam and wall during construction of said tank.

13. The method of constructing a prestressed container wall, comprising the steps of:

erecting a concrete wall, casting a plurality of discrete, horizontal, collar-shaped beams in place surrounding said wall, said beams being vertically spaced from each other along said wall, the total circumferential area of said beams being less than the circumferential area of said wall, and applying metal prestressing means in tension around said beams to precompress said beams.

14. The method of claim 13 which includes the step of slipforming said concrete wall.

* * * * *